US008836628B2

(12) United States Patent
Lee

(10) Patent No.: US 8,836,628 B2
(45) Date of Patent: Sep. 16, 2014

(54) METHOD AND DEVICE FOR DRIVING LIQUID CRYSTAL PANEL USING DOT INVERSION SYSTEM

(76) Inventor: Sung Ho Lee, Hwaseong-si (KR)

( * ) Notice: Subject to any disclaimer, the term of this patent is extended or adjusted under 35 U.S.C. 154(b) by 50 days.

(21) Appl. No.: 13/824,366

(22) PCT Filed: Sep. 16, 2011

(86) PCT No.: PCT/KR2011/006891
§ 371 (c)(1),
(2), (4) Date: Mar. 17, 2013

(87) PCT Pub. No.: WO2012/036528
PCT Pub. Date: Mar. 22, 2012

(65) Prior Publication Data

US 2013/0176199 A1 Jul. 11, 2013

(30) Foreign Application Priority Data

Sep. 17, 2010 (KR) ..... 10-2010-0091840

(51) Int. Cl.
*G09G 3/36* (2006.01)

(52) U.S. Cl.
CPC ..... *G09G 3/3685* (2013.01); *G09G 3/3655* (2013.01); *G09G 3/3688* (2013.01); *G09G 3/3614* (2013.01)
USPC ..... 345/96; 345/98

(58) Field of Classification Search
USPC ..... 345/87, 89, 94–96, 98
See application file for complete search history.

(56) References Cited

U.S. PATENT DOCUMENTS

| | | | | |
|---|---|---|---|---|
| 2002/0041274 | A1 * | 4/2002 | Watanabe | 345/204 |
| 2007/0132703 | A1 * | 6/2007 | Sehata et al. | 345/100 |
| 2008/0224978 | A1 * | 9/2008 | Park | 345/92 |
| 2010/0176736 | A1 * | 7/2010 | Lee et al. | 315/209 R |

FOREIGN PATENT DOCUMENTS

| | | |
|---|---|---|
| JP | 2009-251608 | 10/2009 |
| KR | 10-2002-0048693 | 6/2002 |
| KR | 10-2004-0073703 | 8/2004 |
| KR | 10-2008-0022932 | 3/2008 |
| KR | 10-2008-0061914 | 7/2008 |
| KR | 10-2010-0086754 | 11/2011 |

OTHER PUBLICATIONS

International Search Report for PCT/KR2011/006891, dated Feb. 27, 2012.

* cited by examiner

*Primary Examiner* — Ricardo L Osorio
(74) *Attorney, Agent, or Firm* — Kile Park Reed & Houtteman PLLC

(57) ABSTRACT

Provided is a liquid crystal panel driving method and device employing a dot inversion system. The liquid crystal panel driving method includes the steps of: (a) generating an alternating signal; (b) adding a signal of a different potential to the alternating signal, to then be applied to input ends of a gamma voltage generating unit (72) and a common voltage generating unit (73); (c) applying an alternating common voltage generated from the common voltage generating unit (73) to a common electrode (220); and (d) generating the data voltage whose polarity is inverted in the gamma voltage generating unit (72) on the basis of the alternating common voltage generated by the common voltage generating unit (73). In the dot inversion system, a common voltage is formed to alternate and a data voltage is inverted on the basis of the alternating common voltage, to thereby provide an effect of performing touch detection by using the alternating common voltage in a high-definitive liquid crystal display device (LCD).

11 Claims, 11 Drawing Sheets

FIG. 3a

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 3b

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 4a

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4b

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

METHOD AND DEVICE FOR DRIVING LIQUID CRYSTAL PANEL USING DOT INVERSION SYSTEM

TECHNICAL FIELD

The present invention relates to a method and device for driving a liquid crystal panel by using a dot inversion system, and more particularly, to a liquid crystal panel driving method and device employing a dot inversion system, in which a common voltage is formed to alternate and a data voltage is inverted on the basis of the alternating common voltage, to thus alternate the common voltage even though the dot inversion system is maintained and perform touch detection by using the alternating common voltage.

BACKGROUND ART

Ordinary liquid crystal display devices display images that correspond to video signals thereon, by controlling optical transmittance of liquid crystal cells on liquid crystal panels. A line inversion system, a column inversion system, a dot inversion system, etc., are used as methods of driving liquid crystal cells on liquid crystal panels. In the liquid crystal panel driving method using the line inversion system, polarities of data signals supplied to the liquid crystal panel are inverted depending on row lines on the liquid crystal panel, that is, depending on gate lines and depending on frames, as shown in FIGS. 1A and 1B.

FIG. 2 is a waveform diagram illustrating a correlation of a data voltage (that is, a source output) and a common voltage according to the line inversion. Referring to FIG. 2, in order to display a specific gray, a data voltage illustrated by a dotted line and a common voltage illustrated by a solid line alternate for every one of the gate lines to thus maintain a certain level of voltage difference. Here, the generated voltage is applied to the liquid crystal to control the amount of light and display gray. For example, the voltage difference between the common voltage and the data voltage is 5V to display black. In this case, since the common voltage is larger than the data voltage in the waveform section on the left portion of FIG. 2, the common voltage is 5V and the data voltage is 0V. Next, since the common voltage and the data voltage are line inverted and thus the common voltage is smaller than the data voltage in the waveform section on the central portion of FIG. 2, the common voltage is 0V and the data voltage is 5V. This line driving system is widely used in portable devices because liquid crystal driving voltages are small to cause a small amount of current consumption.

In the liquid crystal panel driving method using the column inversion system, polarities of data signals supplied to the liquid crystal panel are inverted depending on column lines on the liquid crystal panel, that is, depending on data lines and depending on frames, as shown in FIGS. 3A and 3B.

In the liquid crystal panel driving method using the dot inversion system, data signals of opposite polarities are supplied to the adjacent liquid crystal cells on the gate lines and to the adjacent liquid crystal cells on the data lines, respectively, and polarities of data signals supplied to all the liquid crystal cells on the liquid crystal panel are inverted for each frame, as shown in FIGS. 4A and 4B. In other words, in the dot inversion system, in the case that a video signal of an odd-numbered frame is displayed, as shown in FIG. 4A, data signals are supplied to the liquid crystal cells on the liquid crystal panel, respectively, in a manner that a positive polarity (+) and a negative polarity (−) appear alternately as it goes from a liquid crystal cell shown in the uppermost-leftmost corner to the right-side liquid crystal cells, and from the liquid crystal cell shown in the uppermost-leftmost corner to the downward liquid crystal cells. In addition, in the case that a video signal of an even-numbered frame is displayed, as shown in FIG. 4B polarities of data signals supplied to the respective liquid crystal cells are inverted opposite to the odd-numbered frame.

FIG. 5 is a circuit diagram illustrating an example of a gamma voltage generating unit (or a gray scale part) that generates a data voltage in a dot inversion system. Referring to FIG. 5, a gamma voltage generating unit 5 generates a gamma voltage in the outside of a drive IC of a typical liquid crystal display device (LCD) and supplies the generated gamma voltage to a resistor string portion 7. The resistor string portion 7 subdivides the gamma voltage further and indicates required gray scale. In the present embodiment, the resistor string portion 7 has been illustrated to indicate ten (10) gray levels, that is, ten (10) data voltages, but gradation may be increased according to the number of pieces of image data such as sixty-four (64) or two-hundred fifty-six (256).

The gamma voltage generating unit 5 in the dot inversion is divided into a positive area and a negative area based on the common voltage Vcom that is located in the central portion thereof. The terms "positive area" and "negative area" are defined as the positive area when the data voltage is higher than the common voltage and as the negative area when the data voltage is lower than the common voltage. If image data that is externally applied by colors such as red, green, and blue, a data voltage corresponding, to the image data is output. For example, if image data is "08h" in red, a voltage that corresponds to the "$08^{th}$" in the positive or negative area of the dot inversion is read, and a voltage that occurs due to a difference between the voltage corresponding to the "$08h^{th}$" and the common voltage is applied to the liquid crystal, thereby controlling the amount of light in the red region, and displaying an image. In the present embodiment, the positive-side data voltage corresponding to "08h" will be a voltage between r0 and r1, and the negative-side data voltage thereof will be a voltage between r16 and r17. As shown in FIG. 6, these two voltages are repeated to be larger or smaller than the common voltage for each dot on the basis of the common voltage, which is called a dot inversion driving system.

The gamma voltage generating unit 5 buffers a gamma voltage via a gamma buffer 5*a* to then be supplied to the resistor string portion 7. A plurality of gamma buffers 5*a* be are typically used. The gamma voltage generating unit 5 that is divided into a positive area and a negative area is symmetrical up and down on the basis of a common voltage (Vcom) buffer 5*b* in FIG. 5. In the embodiment of FIG. 5, a voltage Vdd that is applied to the final stage of the positive side is 12V, as an example, and a voltage that is applied to the final stage of the negative side is 0V. In addition, VGMA_P4 is 11V and VGMA_N4 is 1V. The common voltage that has been buffered by the common voltage buffer 5*b* between R5 and R6 of the gamma voltage generating unit 5, is connected to a common electrode of the LCD, and the magnitude of the voltage is 6V as an example. Therefore, the highest voltage that can be set at the positive side between the common voltage and the data voltage is 5V, and the highest voltage that can be set at the negative side between the common voltage and the data voltage is also 5V. The data voltage varies depending on the voltage characteristics of the liquid crystal used. In addition, a kick-back effect that occurs when driving the LCD should be considered in order to set a rigid common voltage, but in the illustrated example, the kick-back effect has not been considered to set the magnitude of the common voltage.

FIG. 6 is a waveform diagram illustrating a relationship between the common voltage and the data voltage in the dot inversion. Referring to FIG. 6, in order to apply a voltage difference between the common voltage and the data voltage, that is 5V, the data voltage is applied as 11V in the first dot where the data voltage is greater by 5V than the common voltage 6V, and applied as 1V in the second do where the data voltage is smaller by 5V than the common voltage 6V.

The dot inversion driving system requires a high voltage, and is inverted in every dot, and thus takes a lot of current consumption. On the contrary, since the dot inversion driving system has an excellent picture quality, it is mainly used in order to drive laptop (or notebook) computers, monitors or TVs.

However, since the dot inversion driving system uses direct-current (DC) voltage as the common voltage, the common voltage does not alternate like the line inversion system. Therefore, it is not possible to achieve a second purpose, for example, a purpose of using it for touch detection, by using the alternating common voltage.

DISCLOSURE

Technical Problem

In order to solve the above-mentioned problem, it is an object of the present invention to provide a liquid crystal panel driving method and device employing a dot in system, which is provided to achieve a second purpose of being used for touch detection in a liquid crystal panel using a dot inversion system, in which a common voltage is formed to alternate and a data voltage is inverted on the basis of the alternating common voltage, to thus maintain the dot inversion system without causing degrading the quality of images, and simultaneously achieve a second purpose of performing touch detection by using the alternating common voltage.

Technical Solution

To attain the above object of the present invention, according to an aspect of the present invention, there is provided A method of driving a liquid crystal panel by using a dot inversion system in which a data voltage is inverted on the basis of a common voltage, the liquid crystal panel driving method comprising the steps of:

(a) generating an alternating signal;

(b) adding a signal of a different potential to the alternating signal, to then be applied to input ends of a gamma voltage generating unit (72) and a common voltage generating unit (73);

(c) applying an alternating common voltage generated from the common voltage generating unit (73) to a common electrode (220); and (d) generating the data voltage whose polarity is inverted in the gamma voltage generating unit (72) on the basis of the alternating common voltage generated by the common voltage generating unit (73).

Preferably but not necessarily, the phase of the alternating common voltage is inverted for each of gate lines.

Preferably but not necessarily, the data voltage is inverted for each dot on the basis of the alternating common voltage.

Preferably but not necessarily, the alternating signal is an alternating square wave.

Preferable but not necessarily, the alternating signal alternates both in a positive direction and a negative direction.

According to another aspect of the present invention, there is provided a device for driving a liquid crystal panel by using a dot inversion system in which a data voltage is inverted on the basis of a common voltage, the liquid crystal panel driving device comprising:

an alternating signal generating unit generating an alternating signal;

an alternating signal adding unit adding a signal of a different potential to the alternating signal;

a common voltage generating unit (73) that receives the alternating signal from the alternating signal adding unit, generates an alternating common voltage, and applies the generated alternating common voltage to a common electrode (220); and a gamma voltage generating unit (72) that receives the alternating signal from the alternating signal adding unit, and generates the data voltage whose polarity is inverted on the basis of the alternating common voltage generated by the common voltage generating unit (73).

Preferably but not necessarily, the alternating signal generating unit is an alternating waveform generating unit (70) that generates an alternating square wave.

Preferably but not necessarily, the alternating signal adding unit comprises:

a first adder (71*a*) that adds an output signal of the alternating waveform generating unit (70) and a Vdd signal to then be applied to one end of the gamma voltage generating unit (72); and a second adder (71*b*) that adds the output signal of the alternating waveform generating unit (70) and a Gnd signal to then be applied to the other end of the gamma voltage generating unit (72).

Preferably but not necessarily, the phase of the alternating common voltage is inverted for each of gate lines.

Preferably but not necessarily, the data voltage is inverted for each dot on the basis of the alternating common voltage.

Preferably but not necessarily, the alternating signal alternates both in a positive direction and a negative direction.

Advantageous Effects

In the case of a liquid crystal panel driving method and device employing a dot inversion system according to the present invention, a common voltage is formed to alternate and a data voltage is inverted on the basis of the alternating common voltage, to thereby provide an effect of preventing a medium-sized or large-sized liquid crystal display device (LCD) from degrading in the quality of picture and performing touch detection by using the alternating common voltage.

DESCRIPTION OF DRAWINGS

The above and other objects and advantages of the invention will become more apparent by describing the preferred embodiments with reference to the accompanying drawings in which:

FIGS. 3A and 3B illustrate inversion of polarities in a column inversion system, respectively;

FIGS. 4A and 4B illustrate inversion of polarities in a dot inversion system, respectively;

BEST MODE

Hereinbelow, preferred embodiments of the present invention will be described in detail with reference to the accompanying drawings.

First, the present invention provides a method and device for driving a liquid crystal panel. In particular, unlike a conventional dot inversion system in which a direct-current (DC) voltage is applied as a common voltage in a liquid crystal panel, the present invention provides a liquid crystal panel driving method and device employing a dot inversion system, in which a common voltage is formed to alternate and a data voltage is inverted on the basis of the alternating common voltage. Hereinbelow, driving of the common voltage and the data voltage will be described, but a detailed description of a general configuration of driving a liquid crystal display device (LCD) that is apparent to those skilled in the art will be omitted.

Figure 1A:
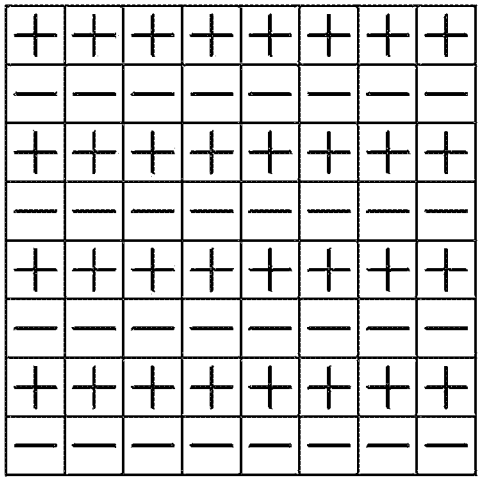
FIGS. 1A and 1B illustrate inversion of polarities in a line inversion system, respectively.
Figure 1B:
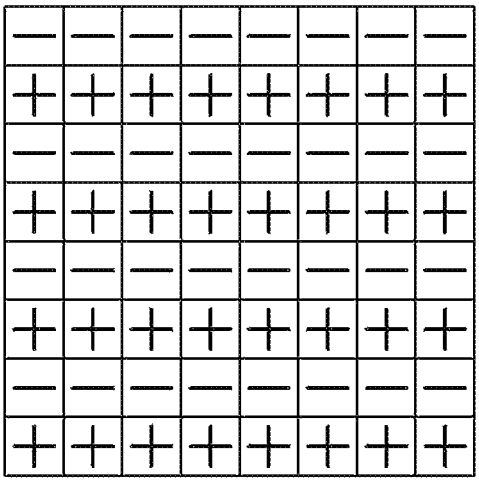
Figure 2:
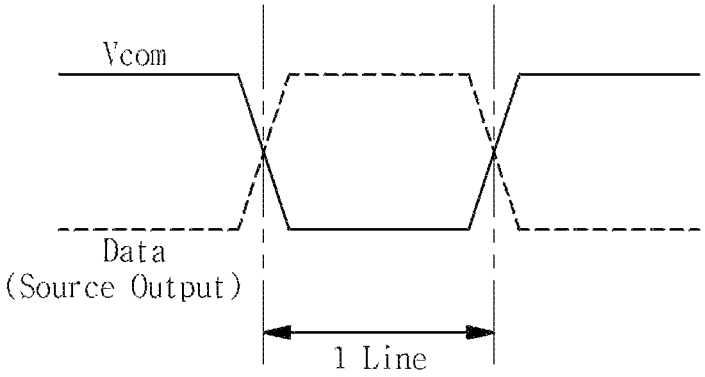
FIG. 2 is a waveform diagram illustrating inversion of polarities in a line inversion system.
Figure 5:
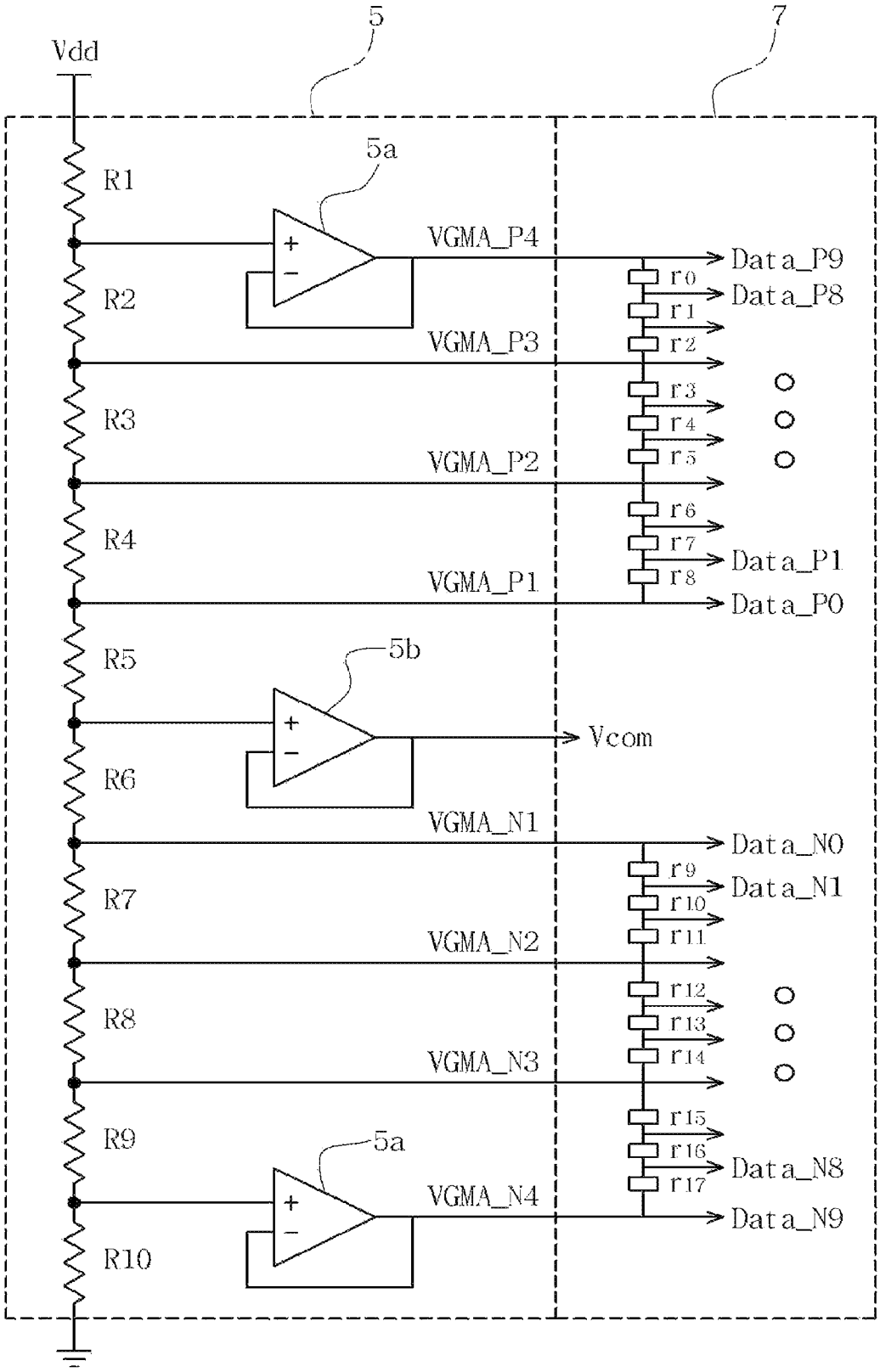
FIG. 5 is a circuit diagram showing a conventional gamma voltage generating unit in a dot inversion system.
Figure 6:
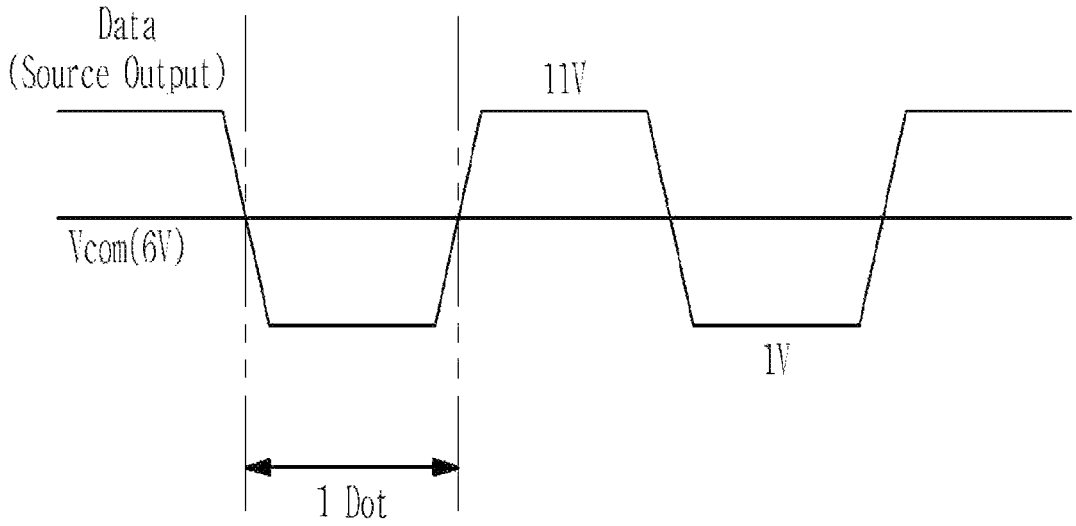
FIG. 6 is a waveform diagram illustrating waveform of a common voltage and a data voltage in a conventional dot inversion system.
Figure 7:
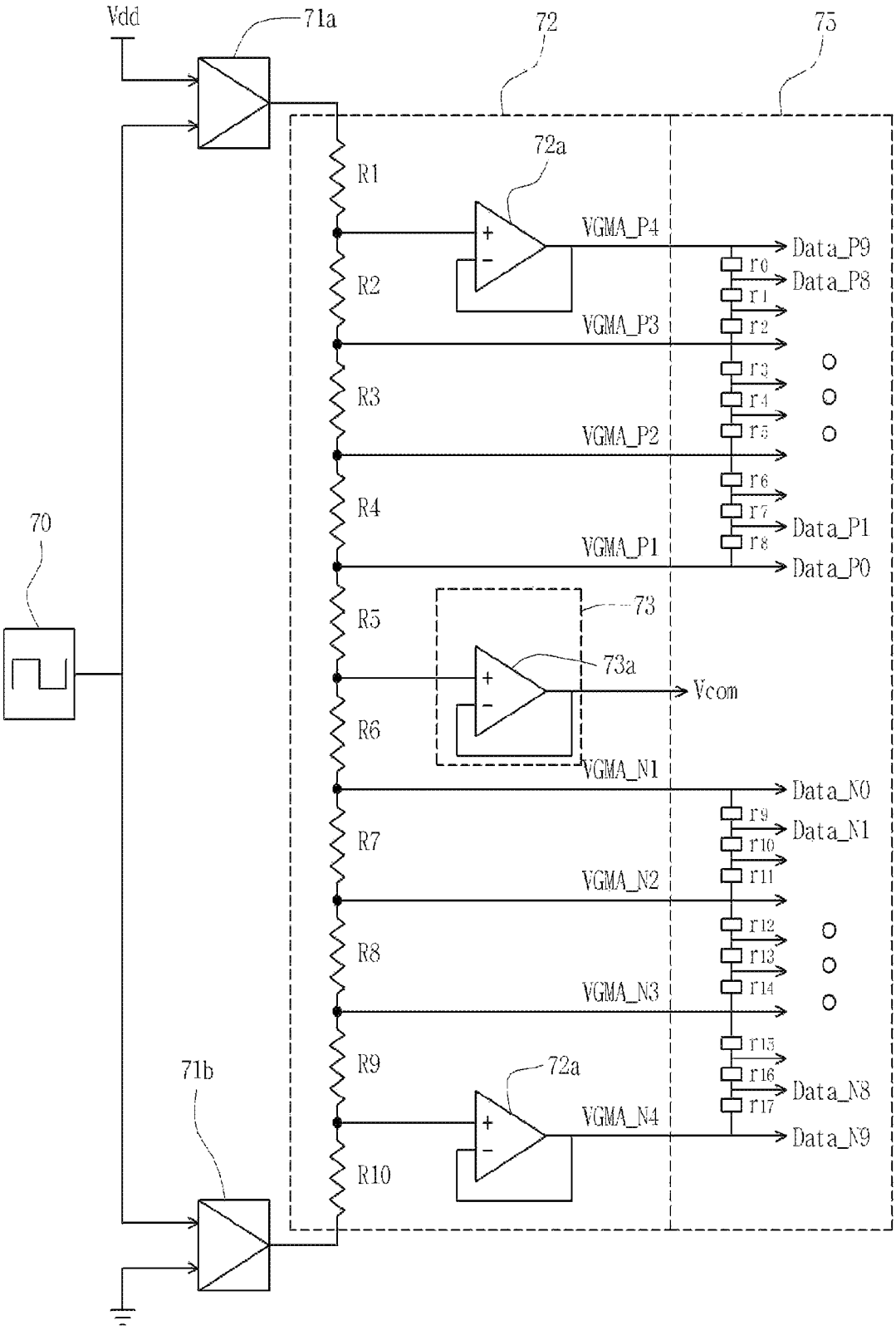
FIG. 7 is a circuit diagram showing a configuration of a driving device according to the present invention.

FIG. 7 is a circuit diagram showing a configuration of a driving device according to the present invention. Referring to FIG. 7, an alternating waveform generating unit 70 is provided at a pre-stage of a gamma voltage generating unit 72. Preferably, the alternating waveform generating unit 70 generates a square wave alternating at a predetermined period of time. As an example, the magnitude of the square wave generated front the alternating waveform generating unit 70 is 4V p-p (peak to peak). The alternating waveform generating unit 70 may output 0V and 4V alternately, or −2V and 2V alternately.

The alternating signal generated from the alternating waveform generating unit 70 is delivered to a gamma voltage generating unit 72. In this case, a first adder 71*a* that receives the output signal of the alternating waveform generating unit 70 and a Vdd signal and a second adder 71*b* that receives the output signal of the alternating waveform generating unit 70 and a Gnd signal are used. The output of the first adder 71*a* and the output of the second adder 71*b* are input to either end of gamma voltage generating unit 72, respectively.

As an example, Vdd is 12V and Gnd is 0V. The positive-side first adder 71*a* receives 4V p-p (peak to peak) from the alternating waveform generating unit 70 and adds Vdd of 12V to 4V p-p. Accordingly, the output of the first adder 71*a* will alternate 12V and 16V. The negative-side second adder 71*b* adds Gnd of 0V to 4V p-p. The output of the second adder 71*b* will alternate 0V and 4V.

Here, it is preferable that the alternating signal alternates line by line. For example, if the magnitude of a square wave that is applied in the first line is 0V, the positive side highest data voltage is 12V and the negative-side lowest data voltage is 0V. In the second line, since the magnitude of the square wave is 4V, the positive-side highest data voltage is 16V and the negative-side lowest data voltage is 4V. Meanwhile, it is preferable that the alternating signals that are applied to the positive-side first adder 71*a* and the negative-side second adder 71*b* that are used in one embodiment of the present invention are in-phase. In the case that the alternating signals that are applied to the positive-side first adder 71*a* and the negative-side second adder 71*b* are not in-phase, the magnitudes of the data voltages that are obtained in the positive- and negative-sides on the basis of the common voltage differ in order to display externally applied identical image data, to thus cause distortion of pictures.

The gamma voltage generating unit 72 buffers a gamma voltage through gamma buffers 72*a* to then be supplied to a resistor string portion 75. A plurality of gamma buffers 72*a* are used. The gamma voltage generating unit 72 that is divided into a positive area and a negative area is vertically symmetric on the basis of a common voltage generating unit 73. As shown, the common voltage generating unit 73 includes a common voltage buffer 73*a* as an example.

The voltages that are obtained by adding the square waves to the existing data voltages, that is, the data voltages that are obtained by offsetting the square waves are output as the gamma voltages such as [VGMA_P1:VGMA_P4] and [VGMA_N1:VGMA_N4] that are output from the gamma buffer 72*a* by the square waves applied from the two adders 71*a* and 71*b*. Thus, the data voltage whose height is varied in synchronization with the square wave is in-phase with the alternating common voltage. Therefore, although the square wave that is the offset voltage has been added, a difference between each of the existing gamma voltages and the common voltage may be maintained. Thus, since the data voltages generated from the resistor string portion 75 are also the data voltages that are obtained by offsetting the square waves in the same as the gamma voltage generating unit 72, a difference between the common voltage and the data voltage before the offset voltage is applied may be identically maintained, to thus cause no distortion in the quality of pictures.

Figure 8:
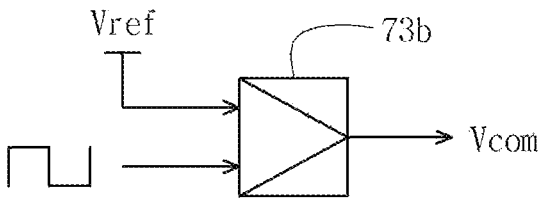
FIG. 8 is a circuit diagram showing another embodiment of a common voltage generating unit.

FIG. 8 is a circuit diagram showing another embodiment of a common voltage generating unit. Referring to FIG. 8, a common voltage buffer 73*a* connected at the intersection of R5 and R6 in the embodiment of FIG. 7 is removed. Instead, the common voltage generating unit 73 includes a third adder 73*b*. In the embodiment of FIG. 8, the square wave generated from the alternating waveform generating unit 70 and the reference voltage Vref are added in the third adder 73*b*. As an example, the reference voltage Vref is 6V, as is in the embodiment of FIG. 7, and thus is a voltage corresponding to a common voltage level before the alternating signal is applied. When the common voltage generating unit 73 is provided as shown in FIG. 8, signal delays due to R1 to R10 are prevented and changes of the common voltage level caused by the difference in the value of the resistance of R1 to R10 may be prevented.

Figure 9A:
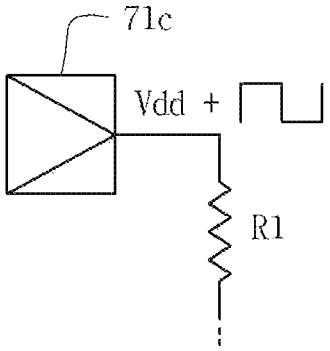
FIGS. 9A and 9B are circuit diagrams showing other embodiments to generate an alternating common voltage, respectively.
Figure 9B:
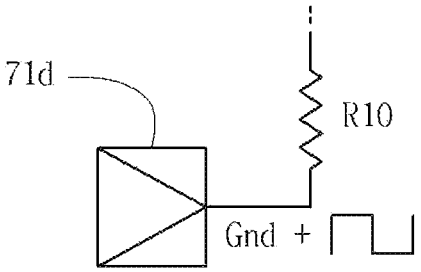

FIGS. 9A and 9B are circuit diagrams showing other embodiments to generate an alternating common voltage, respectively, FIG. 9A shows an alternating voltage generating unit 71*c* that generates a signal which is applied to the positive-side gamma voltage generation unit 72. The alternating voltage generating unit 71*e* directly alternates the Vdd voltage of 12V and 16V, and outputs the alternating Vdd voltage. FIG. 9B shows an alternating voltage generating unit 71*d* that generates a signal which is applied to the net gamma voltage generation unit 72. The alternating voltage generating unit 71*d* also directly alternates the Gnd voltage of 0V and 4V, and outputs the alternating Gnd voltage. Since such configurations mean that a desired alternating signal is directly generated without having a pre-defined alternating signal, the circuit configuration may be simplified.

The alternating waveform may be a triangle wave, a sine wave or a square wave, irrespective of the type of waveform. The alternating waveform is determined according to a second purpose such as touch detection. It is more advantageous to apply a square wave for touch detection.

Figure 10:
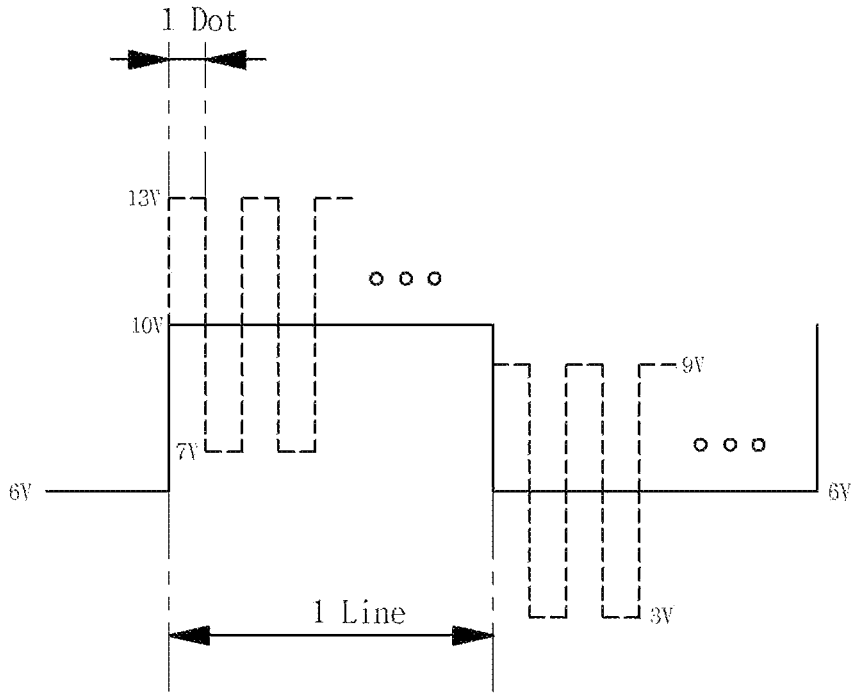
FIG. 10 is a waveform diagram illustrating an example of alternating a common voltage and a data voltage in the present invention.

FIG. 10 is a waveform diagram illustrating an example of alternating a common voltage and a data voltage in the present invention. Referring to FIG. 10, a common voltage that is inverted for each of gate lines is shown by a solid line, in the illustrated example, the common voltage alternates 6V and 10V. Here, the specified voltage is nothing but an example, and the magnitude of the reference voltage and the magnitude of the alternating voltage may be determined in various types. In the embodiment of FIG. 7, the data voltages output from the resistor string portion 75 are dot-inverted on the basis of the common voltages, respectively. Inversion of the data voltages is determined according to whether a polarity of the voltage applied to the liquid crystal is positive or negative.

As an example, the data voltage is inverted to have a voltage difference of 3V with respect to the common voltage. In other words, when the magnitude of the common voltage is 10V, the positive data voltage is output as 13V and the negative data voltage is output as 7V. When the common voltage is 6V, the positive data voltage is 9V and the negative data voltage is 3V.

Therefore, in the present invention, although the common voltage is alternated and the alternating common voltage is supplied, inversion of polarities of the data voltage with respect to the common voltage and the difference between the common voltage and the data voltage may be maintained in the same manner as that of the conventional dot inversion system where a common voltage is provided as a DC voltage. This means that degradation of the image quality does not occur.

Figure 11:
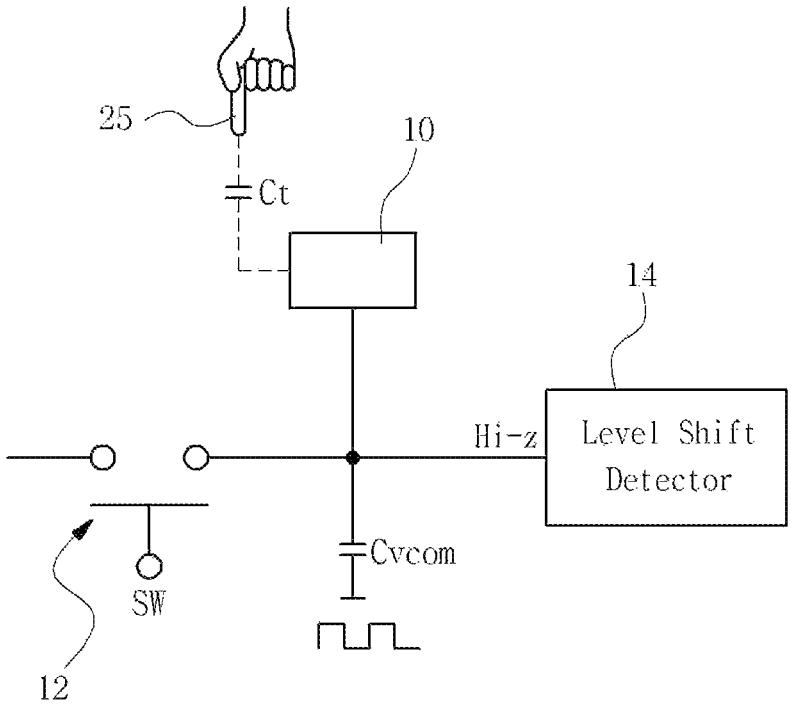
FIG. 11 is a block diagram illustrating an embodiment of touch detection using an alternating common voltage.
Figure 12:
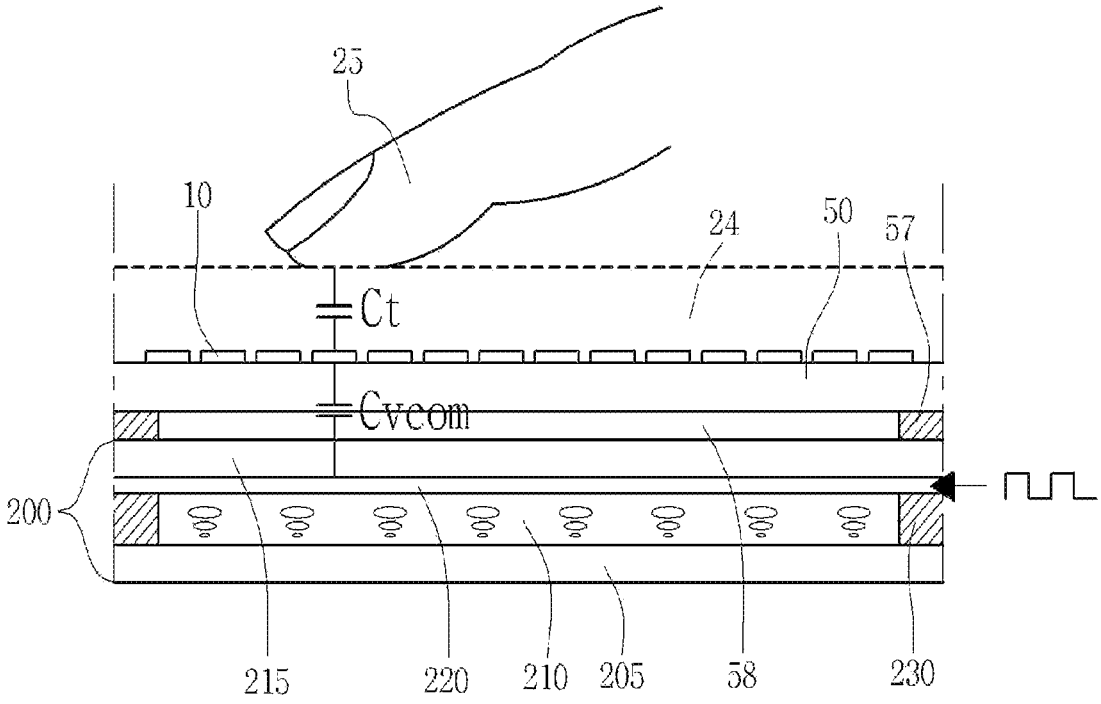
FIG. 12 is a cross-sectional view illustrating an embodiment of touch detection using an alternating common voltage.

FIGS. 11 and 12 show an example of detecting a touch input by alternating a common voltage of a liquid crystal panel. The embodiment of FIGS. 11 and 12 is disclosed in Korean Patent Application No. 10-2010-86754 in the Korean Intellectual Property Office, the disclosure of which is incorporated in its entirety herein by reference.

FIG. 11 is a circuit diagram showing a configuration of a touch detection device and FIG. 12 is a cross-sectional view illustrating a configuration of a touch screen panel. Referring to FIG. 11, the touch detecting device includes a sensor pattern 10, a charging unit 12, and a level shift detector 14. The sensor pattern 10 is an electrode patterned to detect a touch input, and a touch capacitance Ct is formed between the sensor pattern 10 and a finger 25 of a human body, or a touch input instrument such as an electric conductor similar to the finger. As shown in FIG. 12, the sensor pattern 10 is formed on a substrate 50 constituting as touch screen panel. Although it is not shown in the drawing, the sensor pattern 10 may be formed under the substrate 50.

The sensor pattern 10 is formed of a transparent conductive material in the case that a touch screen panel is put on a display device 200. For example, the sensor pattern 10 is formed of a transparent material, such as ITO (Indium Tin Oxide), ATO (Antimony Tin Oxide), CNT (Carbon Nano Tube), or IZO (Indium Zinc Oxide) or a transparent material with conductive characteristics similar to the ITO, ATO, CNT, or IZO. In the case of a touch screen panel such as a touch keyboard or a touch pad that is not mounted on the display device, the sensor pattern 10 may be formed of metal.

The sensor pattern 10 may be patterned in various forms. For example, the sensor pattern 10 may be arranged in a dot-matrix form in which isolated islands are arranged in a matrix form in an active region of a substrate 50, or the sensor pattern 10 may be arranged so that linear patterns are arranged lengthwise and crosswise on the substrate 50. A form of the sensor pattern 10 may be designed in various types depending upon the types and kinds of the touch screen panel.

As shown in FIG. 12, a display device 200 has a common electrode 220. The display device 200 is a liquid crystal panel using a dot inversion system. As shown in FIGS. 7 to 10, an alternating common voltage is applied to the common electrode 220. In the case of the liquid crystal panel, the liquid crystal is sealed and filled between a lower-side thin film transistor (TFT) substrate 205 and an upper-side color filter 215, to thus have a structure of forming a liquid crystal layer 210. To seal the liquid crystal, the TFT substrate 205 and the color filter 215 are joined by sealants 230 at their outer portions. Although they are not shown, polarizing plates are attached on the top and bottom of the LCD panel, and besides optical sheets such as a back light unit (BLU) and a brightness enhancement film (BEF) are provided.

The substrate 50 of the touch screen panel is attached to the upper portion of the display device 200 at the outer portion thereof, through the medium of an adhesive member 57 such as a double adhesive tape (DAT), and an air gap 58 is formed between the substrate 50 and the display device 200. Of course, the touch screen panel may be attached on the display device 200, through other adhesive materials. The touch screen panel may be also incorporated in the display device.

As shown, a common electrode capacitance Cvcom is formed between the sensor pattern 10 and the common electrode 220 of the display device 200. If a certain charging signal is applied to the sensor pattern 10, the common electrode capacitance Cvcom may have a predetermined voltage level by the charged voltage. Here, since one end of the common electrode capacitance Cvcom is grounded to the common electrode 202, the electric potential of the sensor pattern 10 that is the other end of the common electrode capacitance Cvcom may vary by an alternating electric field applied to the common electrode 20. That is, the electric potential of the sensor pattern 10 undergoes voltage variations by the common electrode capacitance Cvcom.

Meanwhile, the aforementioned Ct and Cvcom are symbols that represent both the names and magnitudes of capacitors. For example, the symbol "Ct" means a capacitor named Ct and having a capacitance Ct in magnitude.

The charging unit 12 is a unit for selectively supplying a charging signal to the sensor pattern 10 at a required point in time. The charging unit 12 is a linear device such as a 3-terminal switching device that performs as switching operation in accordance with a control signal supplied to an on/off control terminal, or an operational amplifier (OP-AMP) that supplies a signal according to a control signal.

Referring to FIG. 11, the touch capacitance Ct and the common electrode capacitance Cvcom acting on the sensor pattern 10 are connected to the output terminal of the charging unit 12. Thus, when a charging signal such as any voltage or current is applied to the input terminal of the charging unit 12 at a state where the charging unit 12 has been turned on, the touch capacitance Ct and the common electrode capacitance Cvcom are charged. Here, an unshown parasitic capacitance Cp may be also charged. Thereafter, if the charging unit 12 is turned off, the charged signal is isolated unless the signals charged in the touch capacitance Ct and the common electrode capacitance Cvcom are discharged in a separate way. To stably isolate the charged signals, the input end of the level shift detector 14 has a high-impedance (or Hi-z) state as shown in FIG. 11. If a touch input is observed while discharging the signals charged in the touch capacitance Ct and the common electrode capacitance Cvcom, the charged signals are isolated in the other ways, or the signals are quickly observed at the time of discharge initiation, there is no need to inevitably have a high-impedance (or Hi-z) state at the input end of the level shift detector 14.

The level shift detector 14 detects whether or not a signal level of the sensor pattern 10 is shifted. Preferably, the level shift detector 14 detects whether or not a level shift occurs in a voltage variation of the sensor pattern 10 at the time of occurrence of a touch input (that is, when Ct is added in parallel to Cvcom), in contrast to a voltage variation of the sensor pattern 10 at the time of non-occurrence of a touch input (that is, when Ct is not formed), to thus acquire a touch signal. The level shift detector 14 may have a wide variety of devices or circuit configuration. For example, the level shift detector 14 may include an amplifier, an analog to digital converter (ADC), a voltage to frequency converter (VFC), a flip-flop, a latch, a buffer, a transistor (TR), a thin film transistor (TFT), a comparator, etc., or a combination of these components.

Referring to FIG. 12, the touch capacitance Ct is formed between the finger 25 and the sensor pattern 10, and the common electrode capacitance Cvcom is formed between the sensor pattern 10 and the common electrode 220. In FIG. 12, a portion shown in dotted lines is a planarization layer 24 for protecting the sensor pattern 10. If a protection panel made of reinforced glass is attached on the upper surface of the substrate 50, the planarization layer 24 may be removed.

The voltage variation of the sensor pattern 10 due to the common electrode capacitance Cvcom at the time of non-occurrence of a touch input is determined by following Equation 1.

$$\Delta Vsensor = \pm(VcomH - VcomL)\frac{Cvcom}{Cvcom + Cp} \quad 1$$

Since Ct is added in parallel to Cvcom at the time of occurrence of a touch input, the voltage variation of the sensor pattern 10 is determined by following Equation 2.

$$\Delta Vsensor = \pm(VcomH - VcomL)\frac{Cvcom}{Cvcom + Cp + Ct} \quad 2$$

In Equations 1 and 2, ΔVsensor is a voltage variation in the sensor pattern 10, VcomH is a high level voltage of the common electrode 20, VcomL is a low level voltage of the common electrode 20, Cvcom is a common electrode capacitance, Cp is a parasitic capacitance, and Ct is a touch capacitance.

The level shift detector 14 detects a level shift in the sensor pattern 10 by using Equations 1 and 2, which will be described below in detail.

In Equations 1 and 2, VcomH and VcomL are values that may be easily set up, Cvcom may be obtained from following Equation 3.

$$Cvcom = \varepsilon\frac{S1}{D1} \quad 3$$

In Equation 3, ∈ may be obtained from the dielectric constant (or permittivity) of a medium existing between the sensor pattern 10 and the common electrode 220. For example, since the specific dielectric constant is 3 to 5, in the case of glass, the dielectric constant of the substrate 50 may be obtained by multiplying the specific dielectric constant of glass by the dielectric constant of vacuum, in addition, the dielectric constant of other media may be obtained in this manner. S1 is an opposite area between the sensor pattern 10 and the common electrode 20, which will be easily calculated. In the case that the common electrode 220 is formed over the entire lower surface of the color filter 205 as shown in FIG. 12, the opposite area S1 is determined by an area of the sensor pattern 10. In addition, D1 is a distance between the sensor pattern 10 and the common electrode 220, and thus corresponds to thickness of the medium.

Here, referring to FIG. 12, a plurality of media exist between the sensor pattern 10 and the common electrode 220. In the illustrated embodiment, the substrate 50, the air gap 58, and the color filter 215 exist. Besides, a polarization plate, BEF, etc., further exist. When a plurality of media exist as shown in FIG. 12, Cvcom is equal to a case that capacitors occurring on the opposite surfaces of the dielectric body are connected in series and thus may be obtained from the serially connected capacitors.

As seen, Cvcom is a value that may be easily obtained and set.

The touch capacitance Ct may be obtained from following Equation 4.

$$Ct = \varepsilon\frac{S2}{D2} \quad 4$$

In Equation 4, the permittivity ∈ may be obtained from a medium between the sensor pattern 10 and the finger 25. If the protection panel made of reinforced glass or the planarization layer 24 is attached on the top surface of the substrate 50, in FIG. 12, the permittivity ∈ can be obtained by multiplying the specific dielectric constant of the reinforced glass by the dielectric constant of vacuum. S2 is an opposite area between the sensor pattern 10 and the finger 25. If the finger 25 covers the entire surface of a certain sensor pattern 10. S2 corresponds to the area of the certain sensor pattern 10 that is covered with the finger 25. If the finger 25 covers part of a certain sensor pattern 10, S2 will be reduced by an area of the certain sensor pattern that is not covered with the finger 25. In addition, D2 is a distance between the sensor pattern 10 and the finger 25, and thus corresponds to thickness of the protection panel made of reinforced glass or the planarization layer 24 that is put on the upper surface of the substrate 50.

As described above, Ct is a value that can be easily obtained, and that can be also set up by using the protection panel or the planarization layer 24 that is put on the upper surface of the substrate 50. In particular, according to the Equation 4, since Ct is proportional to the opposite area between the finger 25 and the sensor pattern 10, a touch share of the finger 25 with respect to the sensor pattern 10 cart be calculated from the Ct.

FIGS. 11 and 12 show only an example of detecting a touch input by using an alternating common voltage. The method and device for driving the liquid crystal panel using the dot inversion system according to the present invention may be used for touch detection different from the embodiment of FIGS. 11 and 12. In addition, the method and device for driving the liquid crystal panel using the dot inversion system according to the present invention may be also used or other purposes other than touch detection as long as it is necessary to use an alternating common voltage.

As described above, the invention has been described with respect to the preferred embodiments. However, the invention is not limited to the above embodiments, and it is possible for one who has an ordinary skill in the art to make various substitutions, modifications and variations without departing off the spirit of the invention defined by the claims.

INDUSTRIAL APPLICABILITY

The present invention provides a liquid crystal panel driving method and device employing a dot inversion system, in which a common voltage is formed to alternate and a data voltage is inverted on the basis of the alternating common voltage, to thus alternate the common voltage even though the dot inversion system is maintained and perform touch detection by using the alternating common voltage, which may be applied to input devices which are respectively attached onto display devices such as LCDs (Liquid Crystal Displays), PDPs (Plasma Display Panels), OLED (Organic Light Emitting Diode) displays, and AMOLED (Active Matrix Organic Light Emitting Diode) displays.

The invention claimed is:

1. A method of driving a liquid crystal panel by using a dot inversion system in which a data voltage is inverted on the basis of a common voltage, the liquid crystal panel driving method comprising the steps of:

(a) generating an alternating signal;

(b) adding a signal of a different potential to the alternating signal, to then be applied to input ends of a gamma voltage generating unit (72) and a common voltage generating unit (73);

(c) applying an alternating common voltage generated from the common voltage generating unit (73) to a common electrode (220); and (d) generating the data voltage whose polarity is inverted in the gamma voltage generating unit (72) on the basis of the alternating common voltage generated by the common voltage generating unit (73).

2. The liquid crystal panel driving method of claim 1, wherein the phase of the alternating common voltage is inverted for each of gate lines.

3. The liquid crystal panel driving method of claim 2, wherein the data voltage is inverted for each dot on the basis of the alternating common voltage.

4. The liquid crystal panel driving method of claim 1, wherein the alternating signal is an alternating square wave.

5. The liquid crystal panel driving method of claim 4, wherein the alternating signal alternates both in a positive direction and a negative direction.

6. A device for driving a liquid crystal panel by using a dot inversion system in which a data voltage is inverted on the basis of a common voltage, the liquid crystal panel driving device comprising:

an alternating signal generating unit generating an alternating signal;

an alternating signal adding unit adding a signal of a different potential to the alternating signal;

a common voltage generating unit (73) that receives the alternating signal from the alternating signal adding unit, generates an alternating common voltage, and applies the generated alternating common voltage to common electrode (220); and a gamma voltage generating unit (72) that receives the alternating signal from the alternating signal adding unit, and generates the data voltage whose polarity is inverted on the basis of the alternating common voltage generated by the common voltage generating unit (73).

7. The liquid crystal panel driving device according to claim 6, wherein the alternating signal generating unit is an alternating waveform generating unit (70) that generates an alternating square wave.

8. The liquid crystal panel driving device according to claim 7, wherein the alternating signal adding unit comprises:

a first adder (71*a*) that adds an output signal of the alternating waveform generating unit (70) and a Vdd signal to then be applied to one end of the gamma voltage generating unit (72); and a second adder (71*b*) that adds the output signal of the alternating waveform generating unit (70) and a Gnd signal to then be applied to the other end of the gamma voltage generating unit (72).

9. The liquid crystal panel driving device according to claim 6, wherein the phase of the alternating common voltage is inverted for each of gate lines.

10. The liquid crystal panel driving device according to claim 9, wherein the data voltage is inverted for each dot on the basis of the alternating common voltage.

11. The liquid crystal panel driving device according to claim 10, wherein the alternating signal alternates both in a positive direction and a negative direction.

* * * * *